US005256089A

United States Patent [19]

Kobayashi et al.

[11] Patent Number: 5,256,089

[45] Date of Patent: Oct. 26, 1993

[54] WATER JET PROPULSION UNIT

[75] Inventors: Noboru Kobayashi; Hirofumi Imaeda, both of Iwata, Japan

[73] Assignee: Yamaha Hatsudoki Kabushiki Kaisha, Iwata, Japan

[21] Appl. No.: 756,893

[22] Filed: Sep. 9, 1991

[30] Foreign Application Priority Data

Sep. 14, 1990 [JP] Japan ..... 2-244238

[51] Int. Cl.[5] ..... B63H 11/00

[52] U.S. Cl. ..... 440/38; 440/55

[58] Field of Search ..... 440/38, 40, 42; 114/345

[56] References Cited

U.S. PATENT DOCUMENTS 3,207,116 9/1965 FRX ..... 440/42

FOREIGN PATENT DOCUMENTS 386760 9/1990 European Pat. Off. ..... 440/42

2732671 2/1979 Fed. Rep. of Germany ..... 440/38

*Primary Examiner*—Jesus D. Sotelo

*Attorney, Agent, or Firm*—Ernest A. Beutler

[57] ABSTRACT

Several embodiments of water jet propulsion units that are manually moveable between a downwardly facing in-the-water position and a raised, out-of-the water position. The movement includes pivotal movement about a transversely extending horizontal pivot axis and rotation about a longitudinally extending rotational axis. Latching apparatus are disclosed for holding the jet propulsion unit in at least one of its positions and in one embodiment the latching apparatus is effective to hold the jet propulsion unit in each position.

21 Claims, 7 Drawing Sheets

WATER JET PROPULSION UNIT

BACKGROUND OF THE INVENTION

This invention relates to a water jet propulsion unit and more particularly to an improved water jet propulsion unit wherein the water inlet opening of the water jet propulsion unit may be moved from an in-the-water condition during use to an out-of-the water condition for storage or for servicing so as to prevent the incrustation of the water inlet opening of the water jet propulsion unit and also to facilitate removal of foreign material from the water inlet opening.

Water jet propulsion unit have a number of advantages for use in powering watercraft. These advantages include the ability to operate in shallow water since it is not necessary for a propeller to be submerged in the body of water in which the watercraft is operating in order to propel the watercraft. In one form of water jet propelled watercraft, the water jet propulsion unit is relatively permanently affixed to the hull of the watercraft so as to form a permanent part of it. Although this has advantages, there are some disadvantages. For example, if the water inlet opening of the water jet propulsion unit is maintained submerged at all times, even when the watercraft is not being operated, incrustation of the inlet portion and impeller may occur. In addition, because the water jet propulsion unit is designed to operate in shallow water, the inlet passage of the jet propulsion unit may be clogged and it is desirable to access the inlet opening so as to facilitate removal of the clogging material.

In order to offset these deficiencies, a number of water jet propulsion units have been proposed wherein the jet propulsion unit is mounted within the hull of the watercraft for movement so as to elevate the water jet inlet opening and also to access it for servicing. In all of these applications, the water jet propulsion unit is mounted for movement either about a horizontally disposed transversely extending axis or for rotation about a generally longitudinally disposed axis. In some instances, both forms of motion are provided and only the water inlet portion of the jet propulsion unit may be rotatable so as to access the service opening. In all of the aforementioned arrangements, a power device is provided for achieving the movement of the jet propulsion unit to move the water inlet opening from beneath the body of water in which the watercraft is operating. Although such devices have obvious advantages, they are also expensive.

It is, therefore, a principal object to this invention to provide an improved and low cost water jet propulsion unit wherein the water inlet opening may be moved manually from the body of water in which the watercraft is operating to an elevated out-of-the water position.

It is a further object to this invention to provide an improved and simplified latching mechanism for holding the jet propulsion unit in at least one of its positions.

SUMMARY OF THE INVENTION

This invention is adapted to be embodied in a jet propulsion unit for a watercraft that includes a water inlet portion having a normally downwardly facing water inlet opening for drawing water from the body of water in which the watercraft is operating. An impeller portion contains an impeller for drawing water through the water inlet portion and a discharge nozzle portion is disposed at the downstream end of the impeller portion for discharge of the water pumped by the impeller in a rearward direction to power the watercraft. Means are provide for supporting the jet propulsion unit upon the hull for manual movement of at least the water inlet portion from a lowered, in-the-water position to a raised, out-of-the water position.

DETAILED DESCRIPTION OF THE PREFERRED EMBODIMENTS OF THE INVENTION

Figure 1:
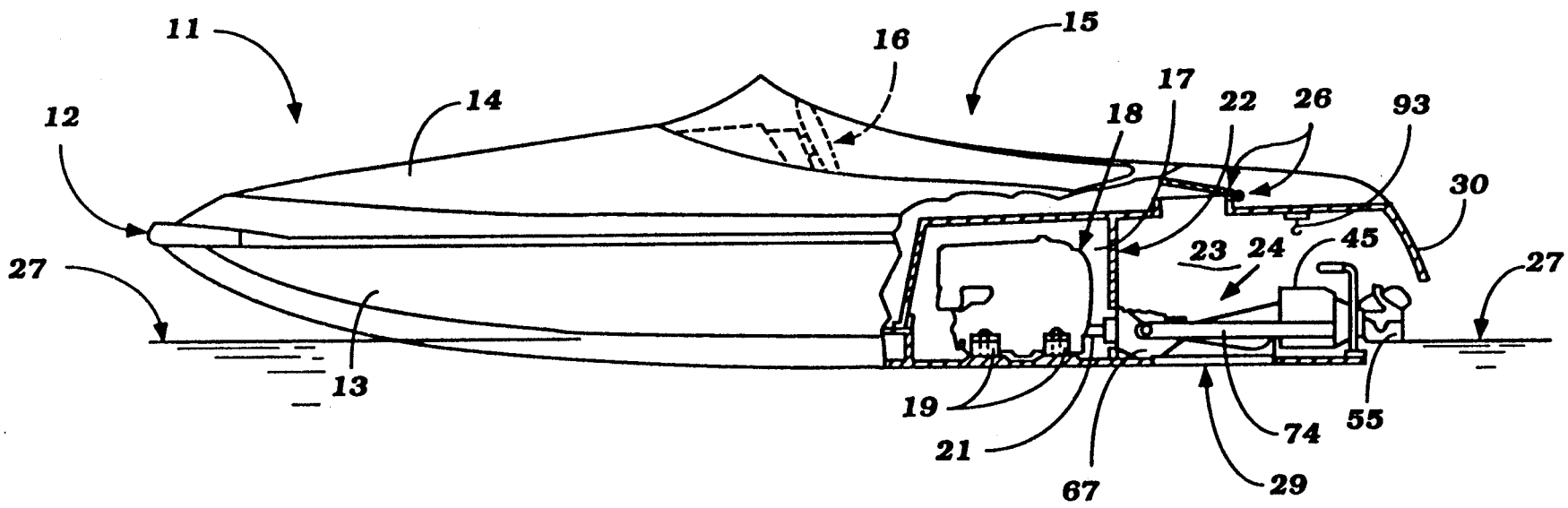
FIG. 1 is a side elevational view of a watercraft powered by a jet propulsion unit constructed in accordance with an embodiment of the invention, with a portion broken away so as to more clearly show certain details of the construction.

Referring first in detail to FIG. 1, a watercraft having a jet propulsion unit constructed and mounted in accordance with an embodiment of the invention is identified generally by the reference numeral 11. The watercraft 11 has a hull, indicated generally by the reference numeral 12 which may have any suitable configuration and which may be comprised of a lower hull portion 13 and a deck portion 14 with these portions being formed from suitable material such as a molded fiberglass reinforced resin. In the illustrated embodiment, the hull 12 is provided with a rearwardly positioned passenger compartment 15 in which a steering wheel 16 and other controls are provided for operating the watercraft 11.

The central rear portion of the lower part of the hull 13 is formed with an engine compartment 17 in which an internal combustion engine 18 of any known type is mounted on engine supports 19. The engine 18 has its output shaft 21 extending rearwardly through a bulkhead 22 formed forwardly of a tunnel 23 that extends generally along the longitudinal axis of the watercraft and in which a jet propulsion unit, indicated generally be reference numeral 24 is positioned. The tunnel 23 is defined in part by a horizontally extending surface 25 of the hull 12 in which an access opening 26 is provided for a purpose to be described. The watercraft 11 is designed to be operated in a body of water at a normal water level as shown by the line 27 in FIG. 1. The rear end of the tunnel 24 is partially closed by a transom plate 30.

Figure 2:
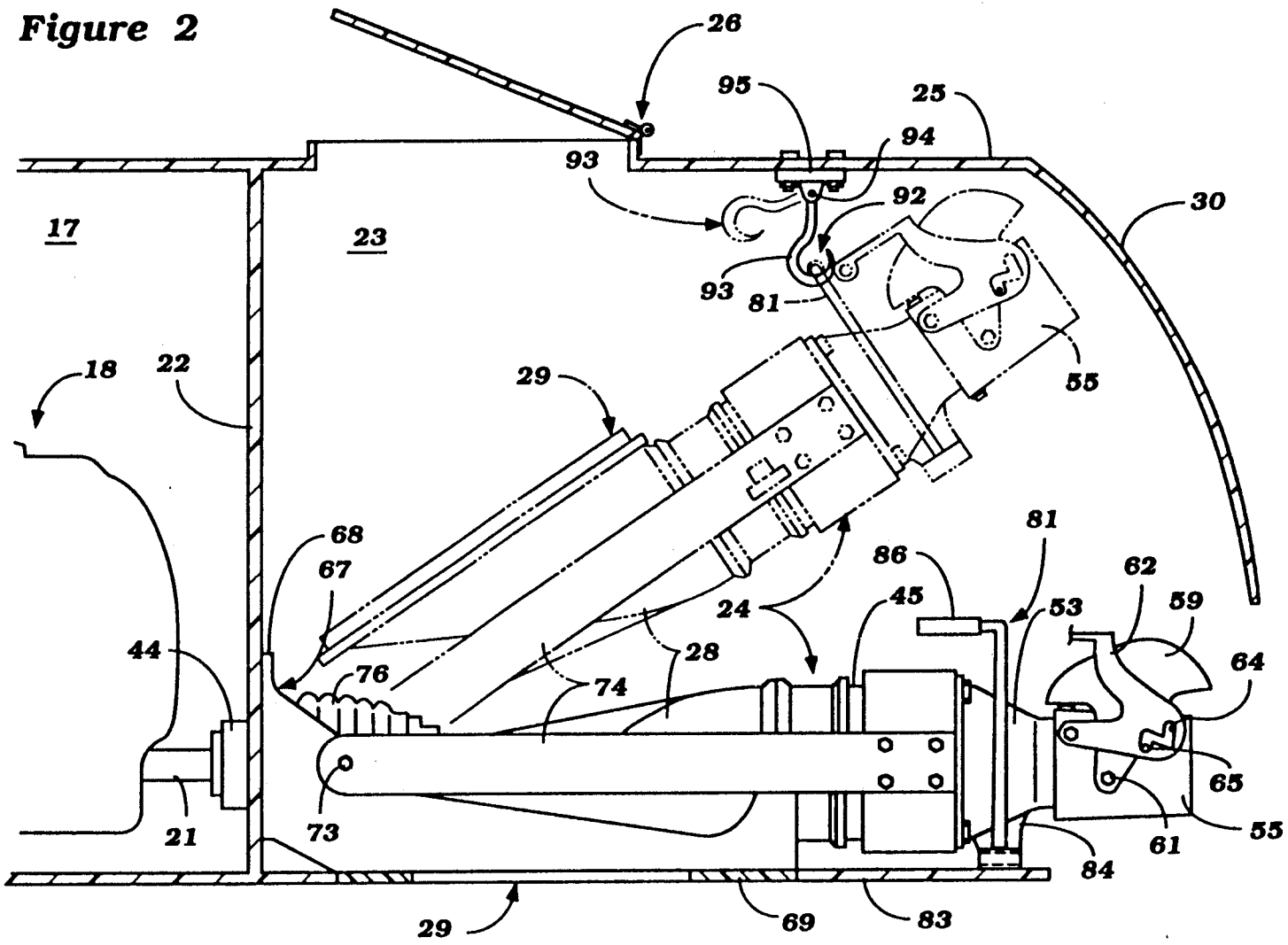
FIG. 2 is an enlarged cross sectional view of the broken away area of FIG. 1 showing the propulsion unit in its normal position in solid lines and in its out of the water servicing position in phantom lines.
Figure 3:
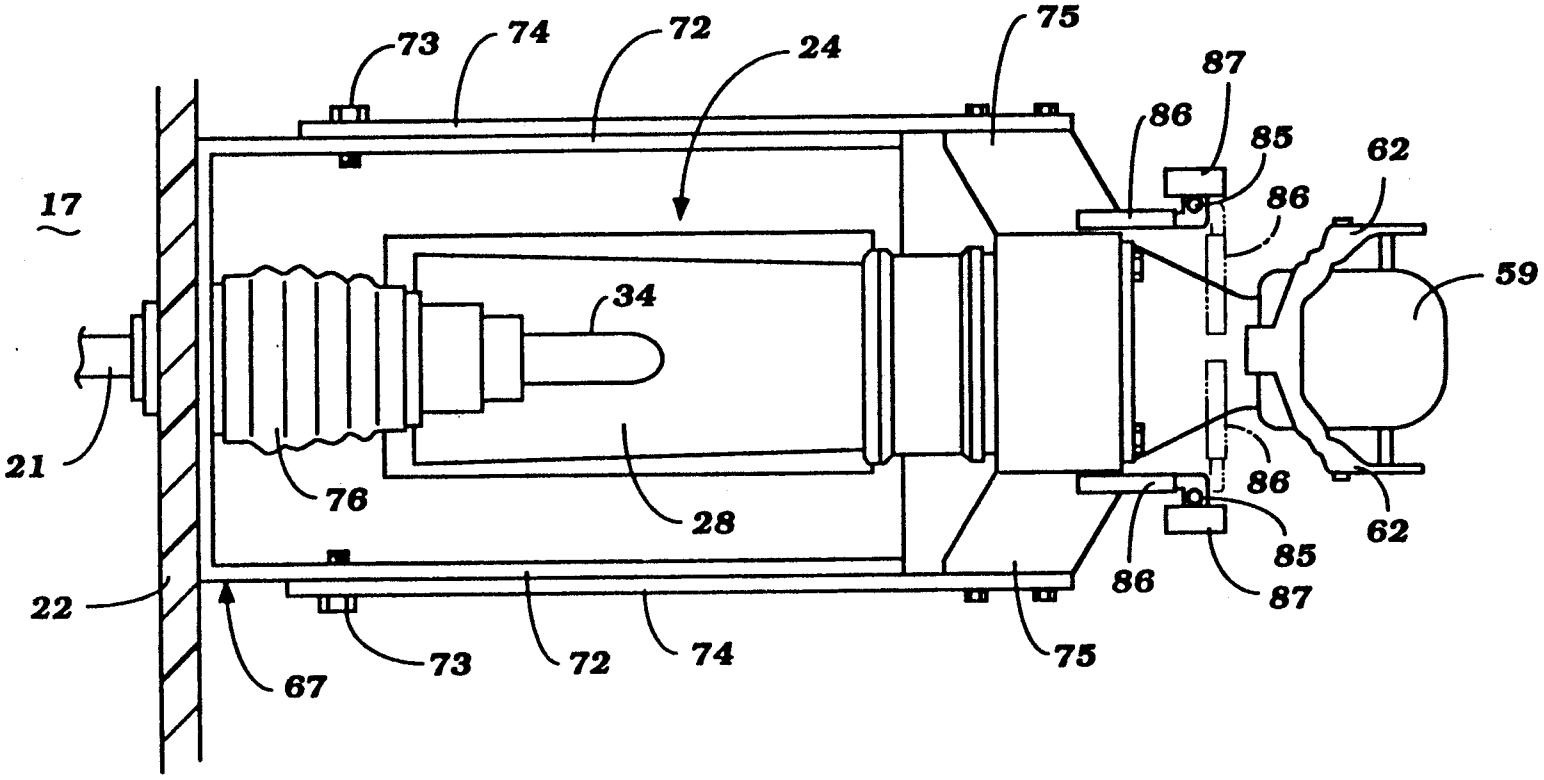
FIG. 3 is a top plan view of the area shown in FIG. 1, with the cover over the tunnel portion removed to show the mounting of the jet propulsion unit.
Figure 4:
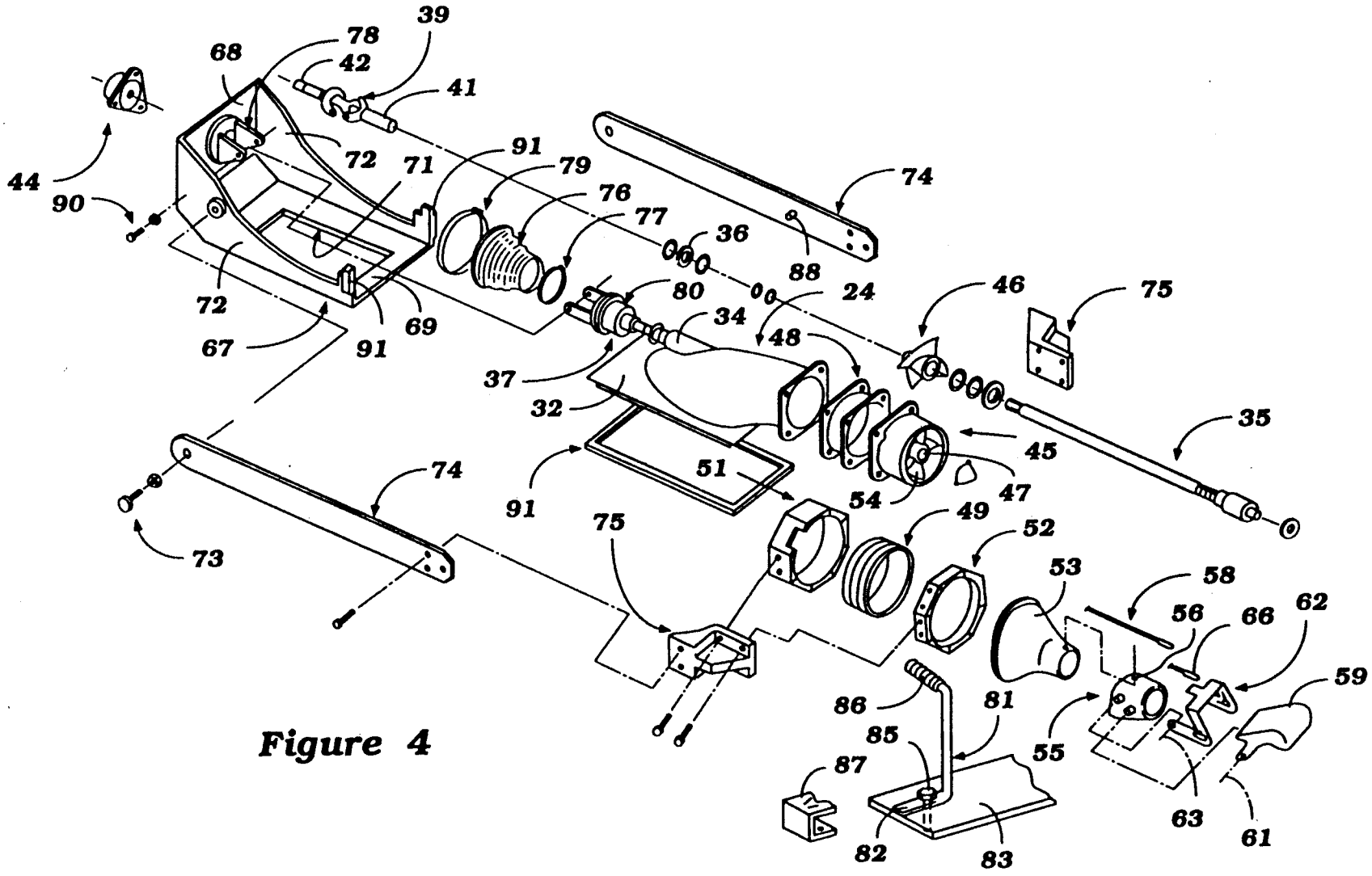
FIG. 4 is an exploded perspective view showing the jet propulsion unit and its mounting arrangement within the watercraft.

Referring now to FIGS. 2 through 4, the jet propulsion unit 24 includes an outer housing that is comprised of an inlet portion 28 that defines a downwardly facing water inlet opening 29. The inlet opening 29 is defined by a grill like screen (not shown) that is affixed to a housing flange 32 of the housing portion 28 and which also faces downwardly. The flange 32 has generally rectangular configuration.

The water inlet portion 28 has a forwardly extending pilot portion 34 that passes an impeller shaft 35. A seal 36 surrounds the impeller shaft 35 within the portion 34 and provides a water seal to preclude water leakage.

The forward end of the housing portion 34 receives a fitting 37 that carries a seal and bearing 38 for journalling the impeller shaft 35 adjacent the forward end thereof. A universal joint, indicated generally by the reference numeral 39 has a yoke portion 41 that has a splined connection to the impeller shaft 35. The yoke portion 41 is, in turn, connected to a further yoke portion 42 that has a splined connection 43 to the engine output shaft 21. This splined connection is contained within a bushing 44 which is mounted in a manner to be described. The aforedescribed connection permits a driving connection between the engine output shaft 21 and the impeller shaft 35 which also permits the jet propulsion unit 24 to be pivoted about a transverse, horizontal axis as defined by the universal joint 39 and a further construction, to be described.

Rearwardly of the inlet portion 28 of the jet propulsion unit outer housing, there is provided an impeller housing, indicated generally by the reference numeral 45 in which an impeller 46 is contained. The impeller 46 is suitably coupled to the impeller shaft 35. The rear end of the impeller shaft 35 is journaled within a bearing assembly 47 that is carried in the impeller housing 45 of the jet propulsion unit housing in a suitable manner. A flange assembly, indicated generally by the reference numeral 48 is provided at the forward portion of the impeller housing 45 for attaching the impeller housing 45 to a corresponding flange of the water inlet portion 28.

The impeller housing 45 is formed with a cylindrical surface that is journaled by means of a bushing 49 within a bearing member 51. The bearing member 51 is, in turn, affixed by means of a coupling plate 52 to a discharge nozzle 53 which also forms a component of the outer housing assembly of the jet propulsion unit 24. The discharge nozzle 53 receives water which has been discharged from the impeller section 45 by the impeller 46 past straightening vanes 54 formed integrally with the impeller housing 45.

A steering nozzle, indicated generally by the reference numeral 55 is supported for steering movement at the discharge end of the discharge nozzle 53 by means of vertically extending pivot pins 56. The steering nozzle 55 has an outwardly extending steering arm (not shown) formed integrally with it to which a bowden wire 58 is affixed by a suitable coupling. The forward end of the bowden wire 58 is connected to the steering wheel 16 in appropriate manner for steering of the watercraft in a manner as is well known with such jet propulsion units.

A reverse thrust bucket 59 has arm portions that are journaled on opposite sides of the steering nozzle 55 by means of pivot pins 61 for movement between a normal forward drive position spaced from the end of the discharge nozzle 53 as shown in the figure and in a reverse thrust position across the end of the discharge nozzle 53. An actuating lever 62 is also pivoted on the steering nozzle 55 by means of pivot pins 63 and has a cam slot 64 that receives pins 65 of the reverse thrust bucket 59. An operating bowden wire 66 is connected to the actuating lever 62 and is operative when pulled to pivot the actuating lever 62 and move the reverse thrust bucket 59 between its forward and reverse positions. The forward end of the bowden wire 66 is connected to an appropriate control positioned in the passenger compartment 15 which control does not appear in the figures.

The construction by which the jet propulsion unit 24 is mounted within the tunnel 23 will now be described still by particular reference to FIGS. 2 through 4. This mounting arrangement includes a cradle assembly, indicated generally by the reference numeral 67 which is affixed in a suitable manner to the rear side of the bulkhead 22 and to which bushing 44 is affixed. The cradle assembly 67, has a generally vertically extending wall 68 that is positioned in confronting relationship to the rear side of the bulkhead 22 and a horizontally extending portion 69 in which an opening 71 is formed which opening registered with the inlet opening 29 of the jet propulsion unit housing portion 28.

The cradle assembly 67 also has a pair of vertically extending side walls 72 that are integrally connected with the front wall 68 and the bottom wall 69 so as to offer reinforcing. In addition, the side walls 72 receive pivot bolts 73 that are aligned with the universal joint 39, for a reason to be described, and which pivotally journal a pair of spaced apart support arms 74 at their forward ends. The support arms 74 are, in turn, affixed at their rear ends to mounting brackets 75 which brackets are affixed by threaded fasteners to the support arm 74 and to the bearing member 51. As a result of this construction, the jet propulsion unit 24 will be pivotally supported by the cradle assembly 67 about a transversely extending horizontal pivot axis defined by the pivot bolts 73.

This pivotal movement is accommodated by the universal joint 39 as aforedescribed. The universal joint 39 is encircled and sealed by means of a flexible boot 76 that is secured to the fitting 37 by means of a clamp 77 and secured to an extending portion 78 of the mounting cradle assembly 67 by means of a clamp 79 so as to provide good water tight sealing for the universal joint 39 while permitting its free rotation and free pivotal movement.

The fitting 37 has a pair of forwardly extending arms 80 that are pivotally connected to a pair of extending arms of the portion 78 of the cradle 72 by means of pivot bolts 90 so as to further provide pivotal support for the jet propulsion unit 24 relative to the cradle assembly 67.

The pivotal movement of the jet propulsion unit 24 about the horizontally disposed transverse axis defined by the pivot bolts 73 and 90 permits manual movement of the jet propulsion unit 24 from its normal operative position as shown in FIG. 2 to an elevated position as shown in the phantom line view of FIG. 2. This permits the water inlet 29 to be raised out of the body of water in which the watercraft is operating above the normal water level 27 so as to preclude the likelihood of incrustation occurring on the water inlet portion 29.

The jet propulsion unit 24 is maintained in its normal operative position as shown in the solid line view of FIG. 2 and in the remaining figures of this embodiment by means of a latching mechanism, indicated generally by the reference numeral 81. This latching mechanism 81 is comprised of a pair of levers having base portions 82 that are pivotally supported on a cross plate 83 that is affixed in a suitable manner to the underside of the discharge nozzle 53 by means of a supporting cradle 84. Pivot pins 85 which extend through the cross plate 83 accomplish this pivotal movement of the levers which have operating handles 86 at their upper ends.

The handle base portions 82 cooperate with respective keepers 87 which are affixed in a suitable manner to the sides of the lower hull portion 13 adjacent the tunnel opening 23, such as the illustrated bolt and nut fasteners.

Figure 5:
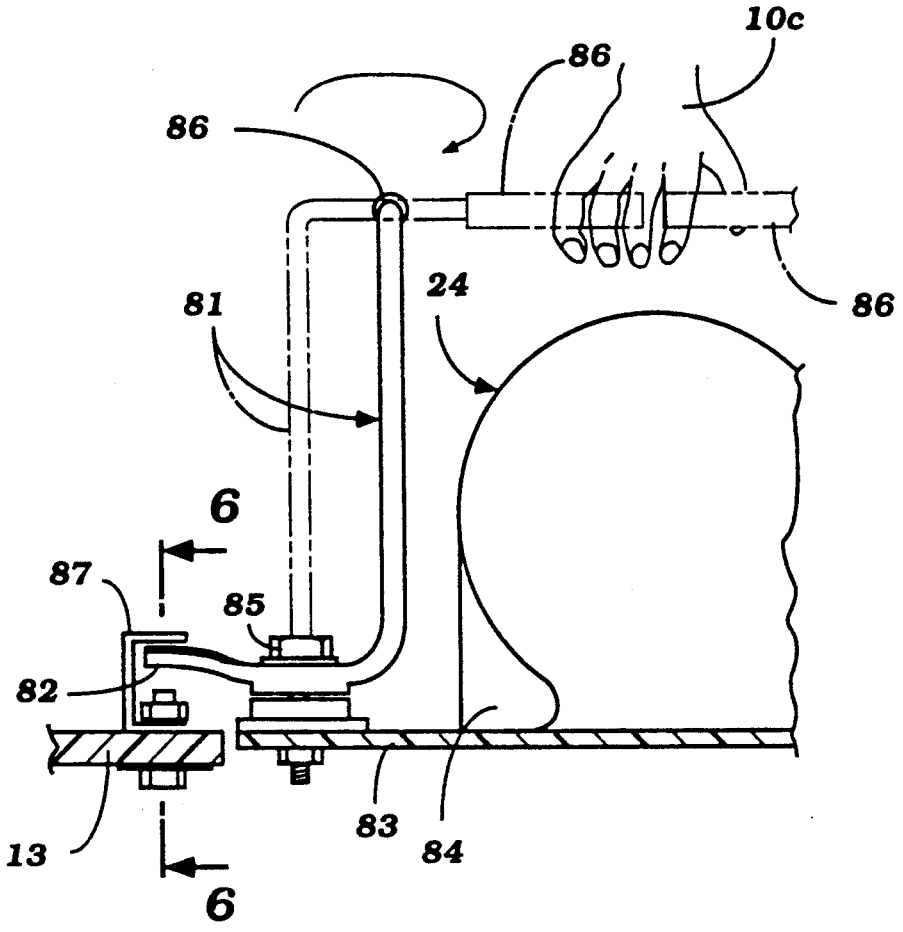
FIG. 5 is an enlarged rear elevational view showing the operation of the locking mechanism that locks the jet propulsion unit in its normal operative condition.
Figure 6:
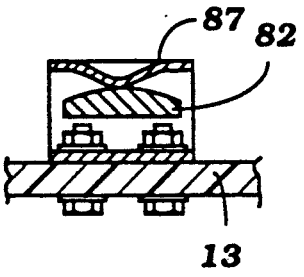
FIG. 6 is a cross sectional view taken along the line 6—6 of FIG. 5.

The locking mechanism 81 is rotatable between the locked position as shown in the solid line view of the figures and particularly FIGS. 5 and 6, wherein the portion 82 cooperates with the keepers 87 so as to urge a seal, to be described, carried by the water inlet portion flange 32 with the cradle portion 69 around the opening 72 to effect tight sealing engagement. An operator may reach through the access opening 26 and rotate the handle portions 86 through 90° from their locked position to their release position as shown in broken line views in the figures. The jet propulsion unit may then be pivoted upwardly and retained in its upward out-of-the water position, in a manner to be described.

It should be readily apparent that there are substantial side thrusts generated on the jet propulsion unit 24 when in its operating position and particularly when the steering nozzle 55 is pivoted. The support arms 74 and their rigid connection to the bearing member 51 through the mounting bracket 75 insures a rigid assembly that will take these side thrusts. In addition, the support arms 74 have inwardly extending pin portions 88 which are received in complementary recesses formed in upstanding portions 91 of the cradle assembly 67 when the jet propulsion unit 24 is in its normal operative position so as to insure a rigid assembly with minimum likelihood of movement under these forces.

It should be readily apparent that the pivotal movement of the jet propulsion unit 24 between its normal operative position and its raised out of the water position can be accommodated by flexure of the wire actuators 58 and 66. Their protective sheaths are affixed by means of a fastener or retainer to the mounting bracket 75 at one side of the jet propulsion unit 24 so as to insure against kinking of the transmitters.

In addition to the pivotal movement about the transversely extending horizontal axis, the jet propulsion unit 24 is constructed so that the water inlet portion 28 may be manually rotated between a downwardly facing position as shown in FIGS. 1, the solid line view of FIG. 2, and an upwardly facing position as shown in the phantom line view of FIG. 2. This brings the water inlet opening 29 in registry with the access opening 26 so that any entrapped foreign material may easily be removed without necessitating removal of the watercraft 11 from the body of water in which the watercraft is operating. It is not necessary to rotate the entire jet propulsion unit 24 but only the water inlet portion 28 thereof. The structure for accomplishing this result is also shown in FIGS. 2 through 4.

It has been previously noted that the impeller housing 45 is mounted within the bearing member 51 for rotation by the bushing 49 and that the impeller housing 45 is affixed to the water inlet portion 28. When the jet propulsion unit 24 is pivoted about the horizontal pivotal axis to a raised position, the inlet portion 28 and impeller portion 45 may be rotated from their downwardly facing position to the upwardly facing position by the operator extending his hands through the access opening 26 and rotating these components of the jet propulsion unit 24. When the jet propulsion unit 24 is in its lowered position, the engagement of the flange 32 and specifically a seal 91 carried thereby with the cradle surface 69 will preclude any such rotation.

A latching mechanism, as aforenoted, is also incorporated for holding the jet propulsion unit 24 in its raised, out-of-the water storage or service position and this latching mechanism best in FIG. 2.

The latching mechanism, indicated generally by the reference numeral 92 includes a pivotally supported hook 93 that is connected by a pivot pin 94 to a bracket 95 affixed to the hull portion 25. The hook 93 cooperates with the latching mechanism 81 and specifically the handle portion 86 to hold the jet propulsion unit 24 in its elevated position as shown in this figure. As a result, a very simple yet highly effective latching mechanism is incorporated for this purpose and this latching mechanism includes elements of the same latching mechanism that hold the jet propulsion unit in its lowered normal drive position.

Figure 7:
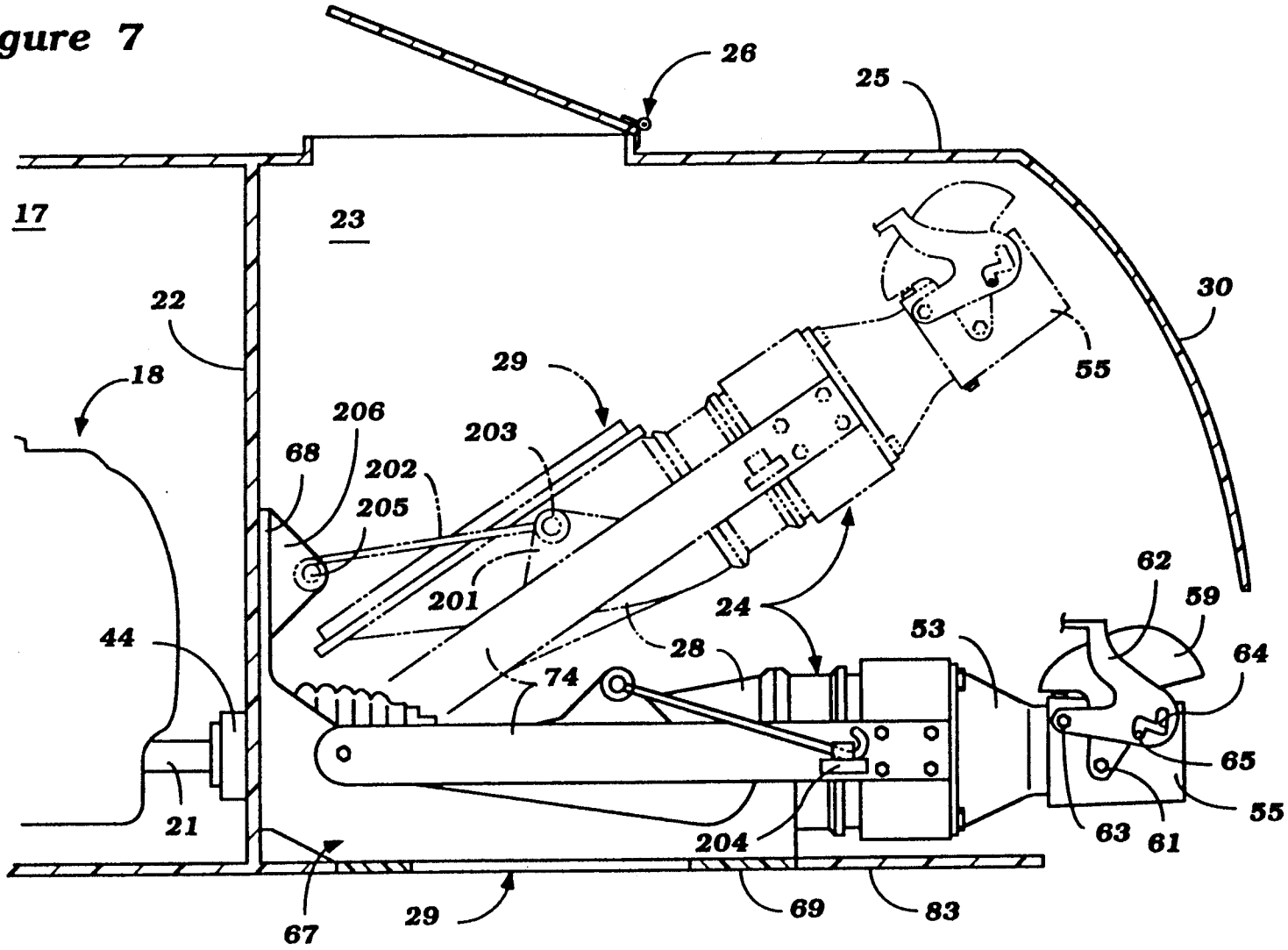
FIG. 7 is a cross sectional view, in part similar to FIG. 2, and shows another embodiment of the invention.
Figure 8:
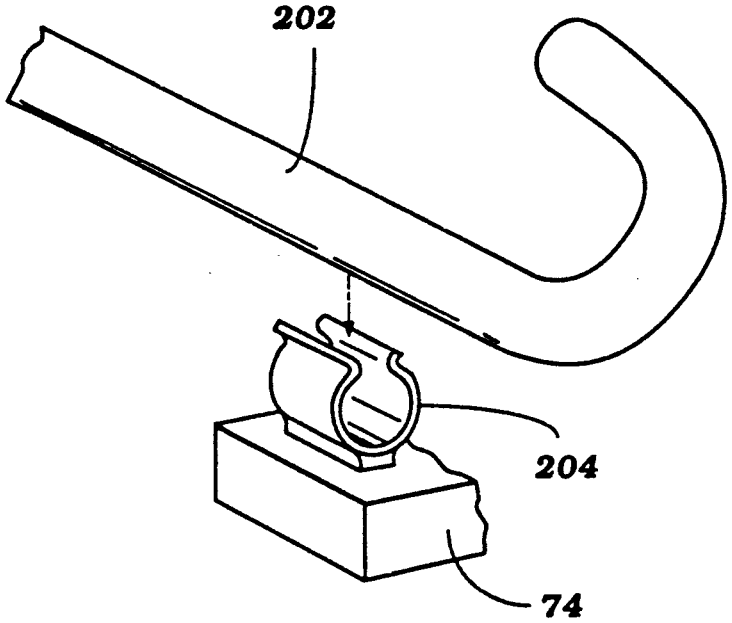
FIG. 8 is an enlarged perspective view showing the locking mechanism of this embodiment.

FIGS. 7 and 8 show another embodiment of the invention and in this embodiment, the jet propulsion unit and its mounting arrangement are the same as that in the previously described embodiment. For that reason, components which are the same have been designated by the same reference numerals and will be described again only insofar as is necessary to understand the construction and operation of this embodiment.

In this embodiment, the jet propulsion unit 24 is retained in its normal operative position merely by its own weight. It should be noted that this unit has substantial weight and, accordingly, a latching mechanism for retaining it in this position may not be required. If desired, however, some form of latching mechanism for this purpose may be incorporated.

In this embodiment, the support arms 74 have upwardly extending lugs 201 that support latching hooks 202 by means of pivot pins 203. The hooks 202 are normally retained in an inoperative or released position within keepers 204 carried at the trailing ends of the support arms 74. However, when it is desired to raise the jet propulsion unit 24, the hooks 202 may be snapped from the keepers 204 and employed to raise the jet propulsion unit 24. The ends of the hooks 202 are then snapped over retainer pins 205 carried by trunions 206 of the upper end of the support cradle 67 and specifically the plate member 68 as shown in phantom line in FIG. 7 so as to hold the jet propulsion unit 24 in its elevated position. The water inlet opening 29, water inlet portion 28 and impeller housing can then be rotated to their upward or access position, as with the previously described embodiment.

It should be readily apparent from the foregoing descriptions that the embodiments of the invention illustrated and described provide extremely effective, low cost water jet propulsion units wherein the water inlet opening at least may be moved manually from a lowered, in-the-water position to a raised, out-of-the water position to prevent incrustation when not in use and also to facilitate servicing. A latching arrangement is incorporated in each embodiment which locks the jet propulsion unit in at least one of its positions. Of course, the foregoing description is that of preferred embodiments of the invention and various changes and modifications may be made without departing from the spirit and scope of the invention, as defined by the appended claims.

We claim:

1. A water jet propulsion unit for a watercraft having a hull defining a tunnel on the underside thereof, said jet propulsion unit including a water inlet portion having a normally downwardly facing water inlet opening for drawing water from the body of water in which the watercraft is operating, an impeller portion for containing an impeller for drawing water through said water inlet portion and a discharge nozzle portion through which water pumped by said impeller may be discharged for powering an associated watercraft, an access opening in said hull for selectively offering access to said tunnel from within said hull, means for supporting said jet propulsion unit at least in major part within said tunnel for manual movement of at least said water inlet portion from a lowered, in-the-water position, to a raised, out-of-the water position, and latching means within said tunnel and accessible through said access opening for releasably retaining said water inlet portion in its raised, out-of-the water position.

2. A water jet propulsion unit as set forth in claim 1 wherein the jet propulsion unit water inlet portion is supported for movement about an axis.

3. A water jet propulsion unit as set forth in claim 2 wherein the axis is an axis that extends longitudinally of the watercraft.

4. A water jet propulsion unit as set forth in claim 3 wherein the inlet portion is rotatable about the longitudinal axis so that the inlet opening moves from a downwardly facing position to an upwardly facing position.

5. A water jet propulsion unit as set forth in claim 2 wherein the axis comprises a horizontally disposed axis extending transversely of the watercraft.

6. A water jet propulsion unit as set forth in claim 5 wherein the jet propulsion unit water inlet portion is also moveable about an axis that extends longitudinally of the watercraft.

7. A water jet propulsion unit as set forth in claim 6 wherein the inlet portion is rotatable about the longitudinal axis so that the inlet opening moves from a downwardly facing position to an upwardly facing position.

8. A water jet propulsion unit as set forth in claim 1 wherein the watercraft is formed with a hull with a tunnel in the underside thereof and the jet propulsion unit is mounted in the tunnel for movement between both positions while substantially within the tunnel.

9. A water jet propulsion unit as set forth in claim 8 wherein the jet propulsion unit water inlet portion is supported for movement about an axis.

10. A water jet propulsion unit as set forth in claim 9 wherein the axis is an axis that extends longitudinally of the watercraft.

11. A water jet propulsion unit as set forth in claim 10 wherein the inlet portion is rotatable about the longitudinal axis so that the inlet opening moves from a downwardly facing position to an upwardly facing position.

12. A water jet propulsion unit as set forth in claim 9 wherein the axis comprises a horizontally disposed axis extending transversely of the watercraft.

13. A water jet propulsion unit as set forth in claim 12 wherein the jet propulsion unit water inlet portion is also moveable about an axis that extends longitudinally of the watercraft.

14. A water jet propulsion unit as set forth in claim 13 wherein the inlet portion is rotatable about the longitudinal axis so that the inlet opening moves from a downwardly facing position to an upwardly facing position.

15. A water jet propulsion unit as set forth in claim 1 where in the latching means is effective to hold the water inlet portion in each of its positions.

16. A water jet propulsion unit as set forth in claim 1 further including a plate affixed to the hull and having a water inlet opening through which water may pass to the jet propulsion unit water inlet portion when in its lowered in-the-water position.

17. A water jet propulsion unit as set forth in claim 16 further including latching means for retaining the water inlet portion of the jet propulsion unit in engagement with the plate opening.

18. A water jet propulsion unit as set forth in claim 17 wherein the latching means comprises a single latching element engaged by a respective cooperating latching element in each of the positions of the jet propulsion unit water inlet portion.

19. A jet propulsion unit for a watercraft including a water inlet portion having a normally downwardly facing water inlet opening for drawing water from the body of water in which said watercraft is operating, an impeller portion for containing an impeller for drawing water through said water inlet portion and a discharge nozzle portion through which water pumped by said impeller may be discharged for powering an associated watercraft, means for supporting said jet propulsion unit upon a hull of the watercraft for manual movement of at least said water inlet portion from a lowered in-the-water position to a raised out-of-the water position, and latching means for releasably retaining said water inlet portion in each of said positions, said latching means comprising a single latching element engaged by a respective cooperating latching element in each of the positions of the jet propulsion unit water inlet portion.

20. A water jet propulsion unit as set forth in claim 19 wherein the jet propulsion unit is positioned within a tunnel formed in the hull of the watercraft and wherein the water inlet portion is accessible through an access opening formed in the hull when the water inlet portion is in its raised, out-of-the water position.

21. A water jet propulsion unit as set forth in claim 20 wherein the single latching element is accessible through the access opening of the hull for latching thereof through said access opening.

* * * * *